United States Patent [19]

Seaborn

[11] 4,407,767

[45] Oct. 4, 1983

[54] DRAWING AND BEAMING A WEFTLESS WARP OF YARNS

[75] Inventor: Douglas K. Seaborn, Cantonment, Fla.

[73] Assignee: Monsanto Company, St. Louis, Mo.

[21] Appl. No.: 380,371

[22] Filed: May 20, 1982

Related U.S. Application Data

[63] Continuation of Ser. No. 89,810, Oct. 31, 1979, abandoned, which is a continuation-in-part of Ser. No. 62,269, Jul. 30, 1979, abandoned, which is a continuation of Ser. No. 960,159, Nov. 13, 1978, abandoned.

[51] Int. Cl.[3] ..... B29C 17/02; D02H 5/02; D02H 13/08

[52] U.S. Cl. ..... 264/40.1; 28/178; 28/187; 28/242; 264/238; 264/290.5

[58] Field of Search ..... 264/40.1, 40.7, 290.5, 264/238; 28/178, 185, 187, 194, 240, 241, 242

[56] References Cited

U.S. PATENT DOCUMENTS 3,351,296 11/1967 Frei ..... 242/153
3,612,791 1/1970 Porter ..... 28/187

*Primary Examiner*—James B. Lowe
*Attorney, Agent, or Firm*—Kelly O. Corley

[57] ABSTRACT

A weftless warp of yarns being drawn and wound on a beam is fed through a tension detector, located prior to the drawing step and responsive to tension in any of the yarns equalling a predetermined non-zero level, for stopping the process. This prevents damage to or breakage of a yarn which might have become snagged in the warp source.

2 Claims, 2 Drawing Figures

DRAWING AND BEAMING A WEFTLESS WARP OF YARNS

This is a continuation of application Ser. No. 89,810 filed Oct. 31, 1979, now abandoned which in turn is a continuation-in-part of application Ser. No. 62,269 filed July 30, 1979, now abandoned, which is turn is a continuation of application Ser. No. 960,159 filed Nov. 13, 1978, now abandoned.

The invention relates to a process for handling a weftless warp of undrawn or spun yarns between a warp source and a beam. More particularly, it relates to such a process wherein damage is prevented in the event that one of the undrawn yarns becomes snagged in the warp source.

It is conventional in the textile industry to form a weftless warp sheet of previously drawn yarns and to wind the warp sheet onto a large spool called a beam. The warp sheets commonly comprise hundreds of thousands of individual yarns, and are unwound from the beams to feed looms, warp knitting machines, and the like.

The source of warp yarns which are to be beamed is typically a creel supporting an individual yarn package of previously drawn yarn for each yarn in the warp sheet. The individual yarns are withdrawn from the packages and fed through an arrangement of guides to form the warp sheet.

All such known prior beaming operations have used previously drawn yarns, i.e., yarns which were individually packaged prior to being creeled for beaming. It was not previously practical to eliminate the separate manufacturing step of individually drawing the several yarns prior to creeling. According to the present invention, this separate manufacturing step of drawing is eliminated, the drawing being done on the warp sheet itself after creeling. This is made practical for the first time by adding, between the warp source (such as a creel) and the drawing step, a tension detector of the type more fully set forth below. In addition to reduced manufacturing costs, the resulting beam is generally found to be exceptionally uniform from yarn to yarn, since all the spun yarns (yarns not yet fully drawn) are subjected to virtually identical conditions during the drawing operation. The term "spun yarns" as used herein refers to those yarns having elongations-to-break above 65%. Spun yarns are considerably more subject to damage due to tension change than are drawn yarns, and increasingly so as the yarn elongation-to-break increases. A relatively low tension level, which would not noticeably affect a drawn (low-elongation) yarn, can cause partial drawing of a spun yarn, resulting in breakage of the yarn during the subsequent drawing operation.

According to the prior practice of beaming previously drawn yarns, the individual yarns would have been separately drawn on different machine positions, with the almost inevitable differences from position to position resulting in differences among the individual yarns. The present invention thus leads to higher quality beams produced at lower cost.

According to a first aspect of the invention, there is provided a beaming process, comprising feeding a weftless warp sheet of spun yarns from a source through a tension detector and winding the warp sheet onto a beam, the tension detector comprising a yarn accumulator for continuously storing a quantity of each yarn constituting the warp sheet and means, responsive to occurrence of tension in any given one of the yarns equal to a predetermined level, for releasing the stored quantity of the given one yarn whereby the tension in the given one yarn does not exceed the predetermined level.

According to another aspect of the invention, the warp sheet is drawn after leaving the tension detector and before it is wound on the beam.

According to another aspect of the invention, the means releases the stored quantity of the given yarn whereby the tension in the given yarn drops to substantially zero.

According to another aspect of the invention, the warp sheet is slashed while being drawn.

Other aspects of the invention will in part appear hereinafter and will in part be obvious from the following detailed description taken in connection with the accompanying drawings, wherein.

Figure 1:
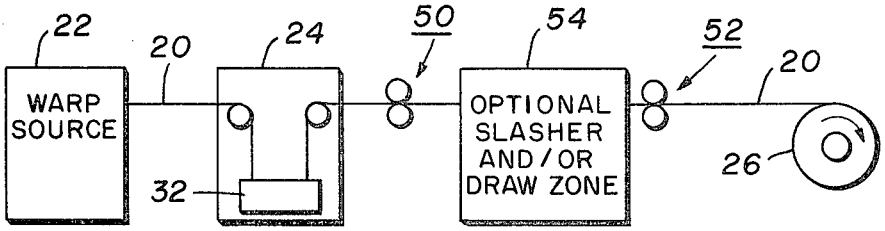
FIG. 1 is a schematic diagram of a first embodiment of the invention.

As illustrated in FIG. 1, in the process of the invention in its broadest aspects, warp sheet 20 composed of a plurality of individual yarns is fed from warp source 22 through tension detector 24, is drawn and optionally slashed, and is substantially wound on beam 26. Warp source 22 will ordinarily be a creel supporting a corresponding plurality of spun yarn packages. Tension detector 24 generates a signal when the tension in any of the spun yarns equals a predetermined non-zero level, and the process is stopped in response to the signal. The predetermined non-zero tension level is selected to be low enough that the process stops before the tension in the yarn rises high enough to damage the easily damaged spun yarn.

Figure 2:
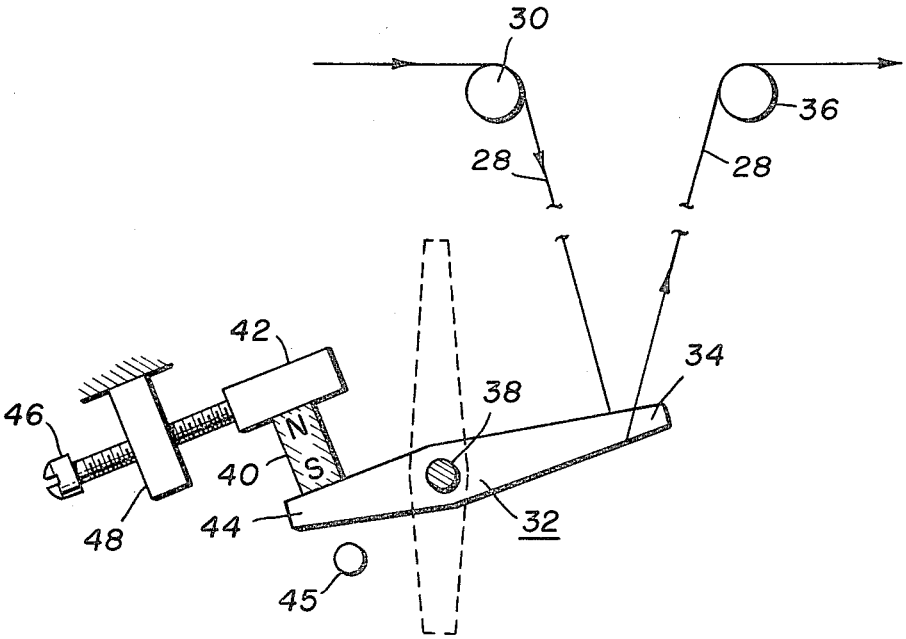
FIG. 2 is a side elevation view, partly in section, of the preferred form of tension detector and yarn release embodying an accumulator according to a specific aspect of the invention.

Tension detector 24 preferably comprises a sensor 32 for each yarn 28, the particularly preferred form of sensor 32 being illustrated in FIG. 2. Each individual yarn 28 passes over stationary bar 30 and loops downwardly under horizontal finger 34 of its associated sensor 32, then upwardly and over roll 36 before proceeding to further processing steps. Ferromagnetic sensor 32 is pivotally mounted on horizontal shaft 38 and is normally maintained in an approximately horizontal position by magnet 40 rigidly mounted on movable support 42 and cooperating with tail 44 on sensor 32. Yarn 28 thus forms a bight in detector 24 whereby the quantity of yarn in the bight is continuously stored. Detector 24 accordingly comprises a yarn accumulator for temporarily and continuously storing a quantity of each yarn constituting the warp sheet.

In operation, sensor 32 is normally maintained in the horizontal position illustrated in solid lines in FIG. 2 by magnet 40. If yarn 28 snags or otherwise encounters excessive resistance in warp source 22, the tension in the yarn will increase to some level predetermined by the strength of magnet 40 and by the distance from magnet 40 to shaft 38 as compared to the distance from shaft 38 to the point on finger 34 contacted by yarn 28. When this predetermined level of tension is exceeded, the magnetic force is overcome and sensor 32 pivots counterclockwise as viewed in FIG. 2. As sensor 32 pivots toward the position indicated in dotted lines, it interrupts a horizontal beam of light perpendicular to the plane of the drawing and directed onto photocell 45. Interruption of the light beam generates a signal which, by conventional control circuitry, stops the process before tension becomes high enough to damage the snagged yarn.

It is essential that tension detector 24 comprise a yarn accumulator, since release of the stored quantity of yarn prevents yarn tension from exceeding the desired level if the process is stopped before the stored quantity of yarn is exhausted. The stored quantity of yarn is accordingly selected with respect to the process speed and inertia so as to be large enough to compensate for the time required to stop the process.

The predetermined level of tension required to actuate finger 34 and thus release yarn 28 can be readily adjusted, according to another aspect of the invention. Screw 46 is threaded through stationary frame member 48 and engages support 42, such that by adjustment of screw 46 the distance between magnet 40 and pivot 38 can be adjusted. Movement of magnet 40 toward pivot 38 lowers the level of yarn tension required to actuate finger 34, while movement of magnet 40 further from pivot 38 increases the required yarn tension.

According to the invention, the process comprises the step of drawing the warp sheet after it leaves tension detector 24 and preferably before it is wound on beam 26, although the step of drawing could be done while transferring the warp sheet from beam 26 to another beam. As illustrated in FIG. 1, warp sheet 20 passes through nip rolls 50 running at a given speed prior to passing through nip rolls 52. Drawing of the entire warp is accomplished by running nip rolls 52 at a higher speed than nip rolls 50, the respective speeds being selected to provide the desired draw ratio.

In the case of spun (less than fully oriented) yarns made from polyethylene terephthalate, draw zone 54 preferably comprises means for heating the entire warp sheet to a temperature high enough to cause crystallization of the yarn. A temperature of about 100° C. is normally sufficient. For nylon 6 and nylon 66, a heater is not normally required.

In addition to the step of drawing the warp sheet, the warp sheet may be slashed after leaving tension detector 24 and before being wound on beam 26. That is, the running warp is passed through a bath of sizing material such as, for example, polyacrylic acid. The warp sheet is then dried as part of the slashing step before the warp sheet is wound on beam 26. The yarns may be separated before drying (referred to as a "wet split") or they may be dried in contact with one another and then separated (referred to as a dry split). The latter procedure is recommended only if the individual yarns have a sufficient amount of twist to prevent filaments from one yarn from being transferred to a different yarn during the splitting step.

The drawing step can be performed in the slasher, as by running the customary quetsch rolls (which squeeze excess liquid from the warp) slower than the slasher output rolls by the desired draw ratio. A wet split is preferred in this embodiment because undrawn yarns ordinarily have insufficient twist to prevent filaments from transferring from one yarn to another when using a dry split.

The above process is made practical by the addition of tension detector 24. In addition, drawing (whether hot or cold) is done more uniformly by handling the yarns as a warp sheet than would be likely if the individual yarns were separately processed. Improvements in quality as well as in economy of operation are thus achieved.

What is claimed is:

1. A beaming process, comprising sequentially:

a. feeding a weftless warp sheet of spun yarns from a source through a tension detector;

b. drawing said warp sheet; and c. winding said warp sheet onto a beam;

d. said tension detector comprising:

(1) a yarn accumulator for continuously storing a quantity of each yarn constituting said warp sheet; and (2) means, responsive to occurrence of tension in any given one of said yarns equal to a predetermined level, for releasing the stored quantity of said given one yarn whereby the tension in said given one yarn does not exceed said predetermined level.

2. The process defined in claim 1, wherein said warp sheet is slashed while being drawn.

* * * * *